US007708350B2

(12) United States Patent
Bussey, Jr. et al.

(10) Patent No.: US 7,708,350 B2
(45) Date of Patent: May 4, 2010

(54) ARTICLE EMPLOYING EXPANDED THERMOPLASTIC ELEMENTS AND METHODS FOR MAKING SAME

(76) Inventors: Harry Bussey, Jr., 960 Cape Marco Dr., Unit 1803, Marco Island, FL (US) 33937; Buddy Harry Bussey, III, 4 Windy Hill, Atlantic Highlands, NJ (US) 07716

( * ) Notice: Subject to any disclaimer, the term of this patent is extended or adjusted under 35 U.S.C. 154(b) by 518 days.

(21) Appl. No.: 11/248,753

(22) Filed: Oct. 12, 2005

(65) Prior Publication Data

US 2007/0080573 A1 Apr. 12, 2007

(51) Int. Cl.
*A47C 5/00* (2006.01)

(52) U.S. Cl. ..... 297/452.17; 297/DIG. 1; 5/655.4; 5/911; 264/46.6; 428/36.5

(58) Field of Classification Search ..... 297/452.17, 297/452.46, 452.47, DIG. 1; 5/655.4, 653, 5/911; 428/35.7, 36.5, 76–77, 34.2, 34.3; 264/46.6

See application file for complete search history.

(56) References Cited

U.S. PATENT DOCUMENTS 3,419,134 A * 12/1968 Fitts ..... 206/221
3,481,455 A * 12/1969 Graham et al. ..... 206/523
4,087,002 A * 5/1978 Bambara et al. ..... 206/523
4,343,047 A * 8/1982 Lazowski et al. ..... 2/411
5,089,191 A * 2/1992 Hughes ..... 264/46.5
5,425,567 A * 6/1995 Albecker, III ..... 297/377
5,449,478 A * 9/1995 Gay et al. ..... 264/45.2
5,611,977 A * 3/1997 Takei ..... 264/46.5
6,093,481 A * 7/2000 Lynn et al. ..... 428/217
6,952,906 B2 * 10/2005 Nelson ..... 53/434
2002/0148045 A1 * 10/2002 Giori et al. ..... 5/709
2005/0023713 A1 * 2/2005 Hansen ..... 264/45.4
2006/0037143 A1 * 2/2006 Green ..... 5/653

* cited by examiner

*Primary Examiner*—Peter R. Brown
(74) *Attorney, Agent, or Firm*—Francis C. Hand; Carella, Byrne, Ceechi

(57) ABSTRACT

An article of manufacture is made by filling a container with expanded thermoplastic elements that are in a non-cured state and that possess a degree of latent foaming ability. After filling the container with the non-cured elements, the elements are allowed to cure under ambient conditions during which the blowing agent remaining in the elements in a vapor state condenses allowing air to be drawn in while the elements expand. This expansion of the elements distends and rigidifies the container where the container is allowed to expand or places an item packaged within a container of rigid construction under a tight fit.

10 Claims, 2 Drawing Sheets

ARTICLE EMPLOYING EXPANDED THERMOPLASTIC ELEMENTS AND METHODS FOR MAKING SAME

This invention relates to articles made of expanded thermoplastic elements and methods for making the same. More particularly, this invention relates to packaging using expanded thermoplastic elements.

As is known, expanded thermoplastic materials such as expanded polystyrene (EPS) have been used for many years as packaging elements, filling elements, padding and the like. Typically, the thermoplastic elements were made by extruding a homogeneous mixture of thermoplastic material and blowing agent through a die having an opening with a cross section suited to the shape of the desired element, for example a C-shaped opening. As the homogeneous mass is extruded through the die, a smooth skin forms on the outside peripheral surfaces of the extrudate. In some cases, equipment is provided for cutting the extrudate into individual discrete elements that are then directed into a container.

It has also been known that the initially expanded thermoplastic elements contain some residual hydrocarbon in a liquid state. Thus, the elements can be subsequently heated in a chamber in order to bring about a further expansion of the elements. It has also been known that the elements can be subjected to a third stage of expansion.

Typically, expansion of the loose fill elements occurs in two or three stages followed by a curing step. This curing step typically subjects the thermoplastic elements to a cooling off period of time such as from 12 to 24 hours. During this time, the heated blowing agent, typically pentane, cools from a vapor state to a liquid state thereby allowing the elements to contract in size. Also, once the hydrocarbon has cooled, air is able to pass from outside the elements into the cells of the elements causing the elements to expand.

It is object of this invention to utilize non-cured expanded thermoplastic elements to make articles of manufacture that can be rigidified upon curing and expansion of the thermoplastic elements.

It is another object of the invention to be able to package articles within containers in a tight fit manner.

It is another object of the invention to provide a process of packaging articles in an efficient tight fit manner.

Briefly, the invention utilizes a mass of discrete non-cured thermoplastic elements to make articles of manufacture and to package articles within a container.

In one embodiment, an article of manufacture is made from a porous container of flexible material and a mass of the non-cured filled plastic elements. In this respect, the porous container is made of a suitable flexible material that is characterized in being expandable from a collapsed state into an expanded three-dimensional shape. For example, the container may be in the form of a pouch or a bag having an open end through which the pouch can be filled and with means for selectively closing the open end in order to seal the contents of the pouch.

In accordance with the invention, a mass of the non-cured elements is filled through the open end of the pouch or bag to an extent that the bag is completely or almost filled and then the bag or pouch closed using the means provided therefor.

Once the container, i.e. pouch or bag, has been filled and closed, the container is set aside to allow the thermoplastic elements to cure in an atmosphere of ambient temperature. Typically, the curing time will be a twelve hour period during which the blowing agent within the discrete elements cools followed by swelling of the elements as air enters through the porous container into the cells of the elements. Typically, the amount of expansion of the elements is from 5% to 15% of the initial state, i.e. the state in which the elements are placed in the container. As a rule of thumb, the ultimate or final size of an element within a container is the size just after the element expands and before the element shrinks. Generally, the thermoplastic elements have a bulk density of 1.0 pounds or less per cubic foot when in place.

The thermoplastic elements within the container are thus characterized in having been expanded from an initial state to an expanded state after filling of the container as well as being characterized in imparting a degree of rigidity to the container in the expanded shape sufficient to maintain the expanded three-dimensional shape of the container. The thermoplastic elements are in a non-cured state and possess a degree of latent foaming ability.

Whether the container is a pouch or a bag, the resulting article may be used as a cushion or pillow. In this respect, the material of the bag or pouch is pervious to a flow of air, for example, being provided with holes or perforations to allow air to enter into the curing thermoplastic elements.

The container is such that the discrete elements are tightly packed together and are resistant to migration within the container.

The container may also have several sections to form different shapes. For example, the container may have a first section forming a seat cushion and a second section forming a back cushion so that the resulting structure provides a cushioned chair for seating an occupant.

In another embodiment, an article of manufacture may be made in tubular form with a wall of flexible material that defines a confined space filled with thermoplastic elements that are cured after filling of the space. Such an article may be used as a flotation device, a drainage element and the like.

The non-cured thermoplastic elements can be used in the hull or hollow seats of a boat for flotation purposes. When the elements cure, a tight flotation aid is presented.

In still another embodiment, the non-cured thermoplastic elements can be used for packaging articles in containers in a tight-fit economical manner. For example, a layer of discrete non-cured thermoplastic elements may be placed in the bottom of a container within the article placed on top of the layer. Thereafter, the container would be filled with further non-cured thermoplastic elements and the container closed to contain the article therein. Thereafter, the thermoplastic elements would be subjected to a curing stage at an ambient temperature sufficient to cure the thermoplastic elements and to effect expansion of the thermoplastic elements from within so that the cured and expanded thermoplastic elements rigidify the container and tightly hold the article within the container. In this respect, since the curing stage requires air to pass into the thermoplastic elements, the container would be provided with holes or openings to permit the inflow of air into the interior of the container.

The flexible container or rigid container can be used to make any suitable item such as a round ball for beach or flotation purposes, a buoyant cylinder for use in pools, life preservers, life jackets, floating mats, seat cushions for stadium seating, drainage mats, fillers for hollow doors, roof panels, side panels and the like. Plastic containers that are filled with the cured thermoplastic elements may be used for safety bumpers, highway abutments and dividers, cushions for football field goal posts.

Further uses include insulation in housing construction, mobile homes, trailers and airplanes. Typically, the curing temperature should be 50° F. or above. However, the temperature may be lower than 50° F. but such would result in a much slower curing process and would result in a lower degree of expansion.

These and other objects and advantages of the invention will become more apparent from the following detailed description taken in conjunction with the accompanying drawings wherein:

FIG. 1 illustrates a perspective view of a cushion constructed in accordance with the invention;

FIG. 2 schematically illustrates a partial cross-sectional side view of a chair constructed in accordance with the invention;

Figure 1:
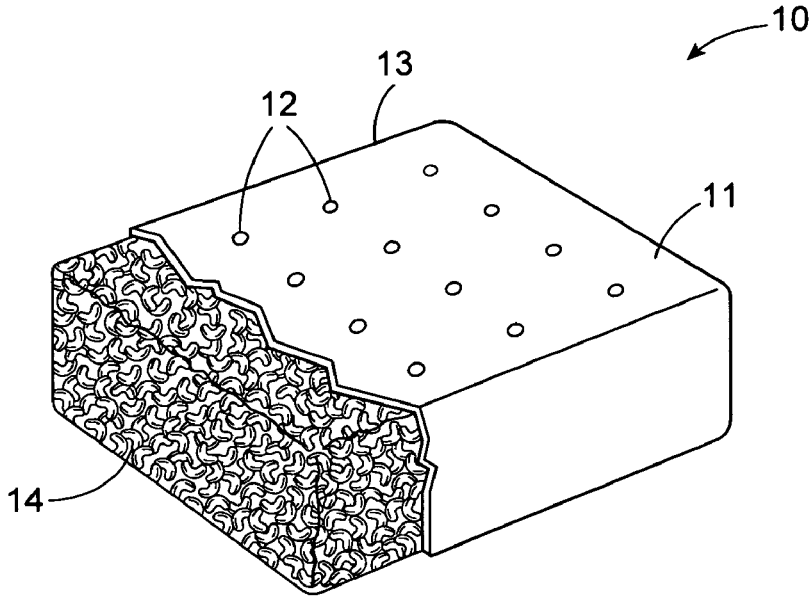

Referring to FIG. 1, the cushion 10 is formed of a pouch 11 of plastic material that is provided with a plurality of openings 12 sufficient to enable air to pass into and out of the interior of the pouch 11. The pouch 11 is typically made with one open end that is close by a heat seal 13 or by any other suitable means. Alternatively, by way of example, the means for closing the pouch may be in the form of two plastic rails having mating cross-sections so that when the two rails are mated together, the rails interlock. A slider is also provided to move along the rails in order to move the rails together into interlocking relation. Movement of the slider in a reverse direction allows the rails to unlock from each other thereby opening the pouch.

The cushion 10 also has a mass of discrete thermoplastic elements 14 contained within the pouch 11.

In order to make the cushion 10, the pouch 11 is opened and a mass of non-cured thermoplastic elements 14, for example expanded polystyrene elements (EPS), are poured into the pouch 11. When the pouch 11 has been filled to capacity or near to capacity, the open end of the pouch 11 is closed, for example, by heat sealing of mouth of the pouch 11 or by using mating rails as described above.

The non-cured thermoplastic elements 14 are obtained from elements that have been extruded in a conventional manner using a suitable extruder and subjected to two stages of expansion, i.e. a conventional first stage expansion with curing thereafter and a second stage expansion without curing. After the second stage expansion and before further curing, the elements 14, i.e. the "non-cured elements" are poured into the pouch 11 before the elements 14 have had time to cure in the expanded second stage state. Thus, the term "non-cured elements" used herein defines thermoplastic elements that have passed through a first stage expansion with curing thereafter and a second stage expansion without curing.

After closing, the pouch 11 is set aside for a period of time and at an ambient temperature to allow the thermoplastic elements 14 to cure. By way of example, the curing stage occurs over a 12 to 24 hour period during which time the blowing agent within the elements 14 cools and air enters into the elements 14 to swell the elements 14. The amount of swelling is 5% to 15% of the initial state of the elements 14 as poured into the pouch 11. Thus, the pouch 11 is expanded by 5 to 15%. This, in turn, rigidifies the pouch 11 to a degree sufficient to maintain the expanded shape of the cushion 10.

Figure 2:
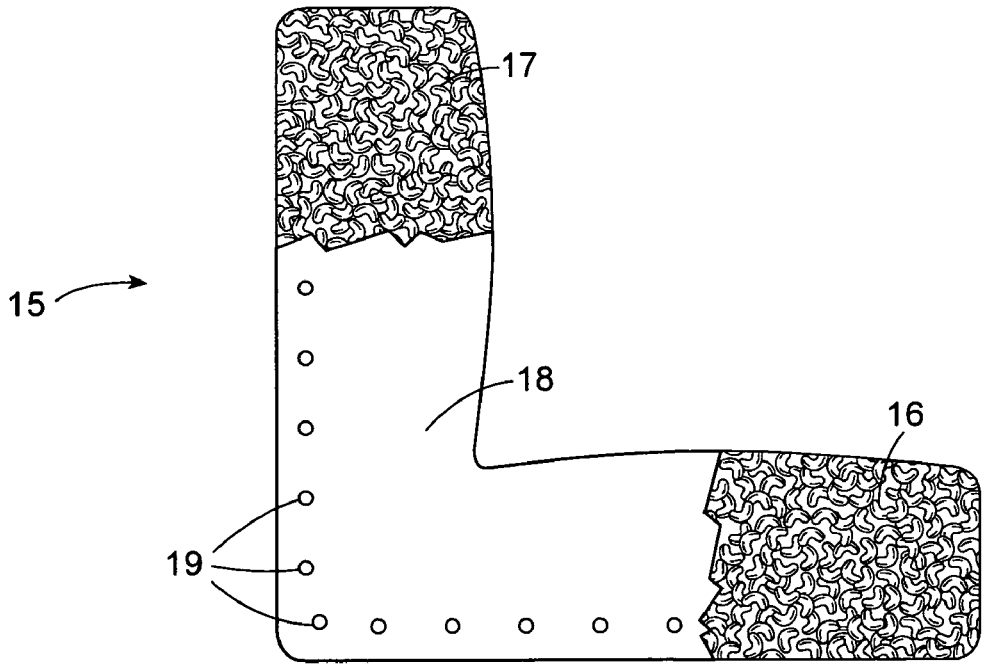
Figure 3:
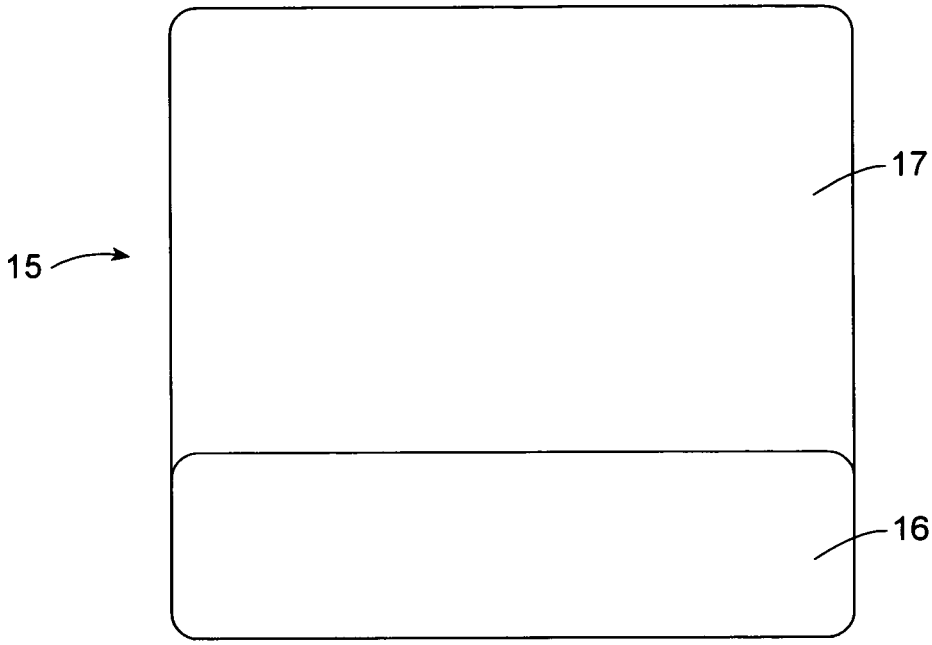
FIG. 3 illustrates a front view of the chair of FIG. 2.

Referring to FIGS. 2 and 3, wherein like reference numerals indicate like parts as above, the non-cured thermoplastic elements 14 may also be used to make a chair 15 having a first section 16 that forms a seat cushion and a second section 17 that forms a back cushion. The chair 15 is made from a container 18 that is of a material suitable for use in a chair and, as above, has one or more openings (not shown) to permit the filling of the two sections 16, 17 with the non-cured expanded polystyrene elements 14. The container also has a plurality of holes 19 for the passage of air into the interior or may be made of an air-permeable material, such as a woven textile material, that allows the passage of air.

As above, after the sections 16, 17 of the container 18 have been filled and closed in a suitable manner by suitable means (not shown), the container 18 is subjected to a curing stage during which time the expanded polystyrene elements 14 swell so as to rigidify each of the two sections 16, 17 of the chair 15.

Figure 4:
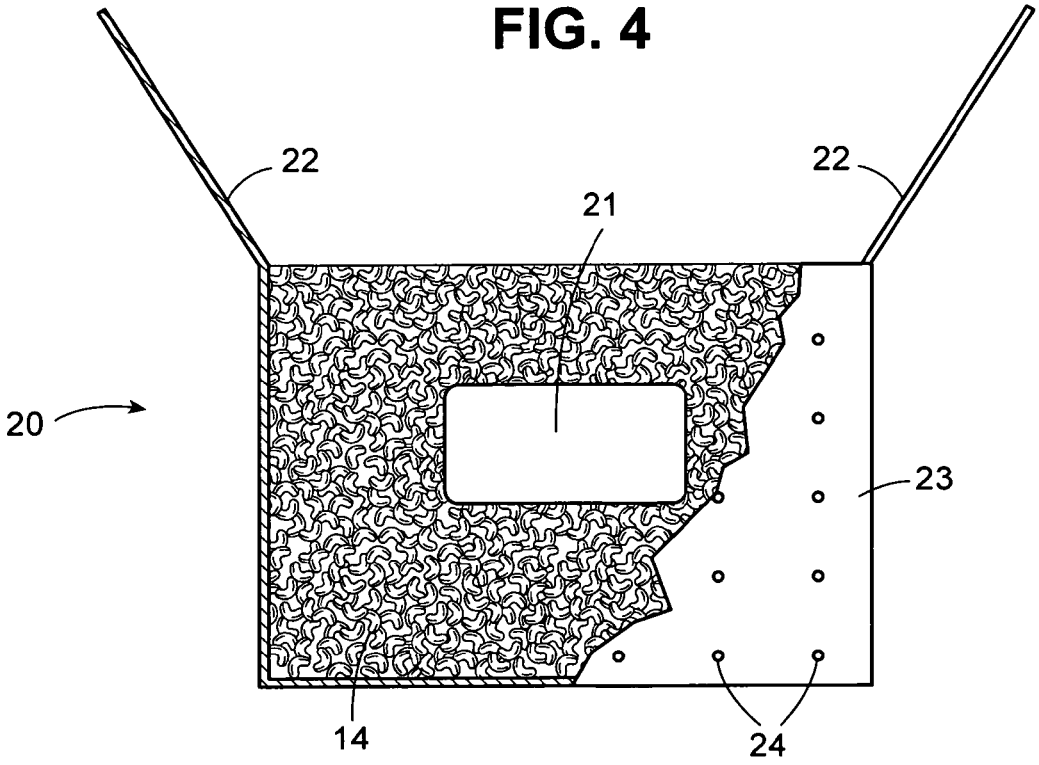
FIG. 4 illustrates a partial cross-sectional view of a container with a packaged article in accordance with the invention.

Referring to FIG. 4, wherein like reference numerals indicate like parts as above, the non-cured expanded polystyrene elements 14 may also be used for packaging purposes. For example, a layer of the non-cured thermoplastic elements 14 may be poured into the bottom of a cardboard container 20 and thereafter an article 21 to be shipped or stored is placed on the layer of elements 14. The remainder of the container is then filled with additional non-cured thermoplastic elements 14 and the flaps 22 of the container 20 closed and sealed to contain the article 20 therein. One or more walls 23 of the container 20 are provided with openings 24 to allow the passage of air into the interior of the container 20.

Thereafter, the closed container 20 is subjected to a curing stage wherein the non-cured thermoplastic elements 14 are cured under ambient conditions in a manner as described above without the need of any external means, such as a heater. As the elements 14 swell within the container 20, the elements 14 rigidify the container 20 and tightly hold the article 21 within the container 20.

It has been known to employ cured thermoplastic elements to package articles within cartons. Typically, a layer of thermoplastic elements is first laid in the container, the article placed on top of the layer and then additional thermoplastic elements are filled into the carton in an over-fill manner. Thereafter, the flaps of the carton are folded over into a closed position while pressing down on the overfilled thermoplastic elements in order to compress the elements and to lock the article in place within the carton. This technique, however, requires an effort to be made to press down the flaps of the carton when closing the carton. The invention provides a technique that avoids this effort.

The container employed by the invention may be made of any suitable material. For example, the container may be in the form of a paper envelope into which an article can be inserted along with a mass of non-cured thermoplastic elements. After closing of the envelope and subsequent curing, the expanded thermoplastic elements will expand the paper envelope and tightly hold the article in place and prevent migration of the article. Such an envelope may be used in place of a conventional paper envelope lined with bubble wrap. If the paper is not permeable, an opening may be allowed within the envelope for the passage of air into the elements during the curing stage.

By way of example, a mass of (EPS) elements were extruded in a conventional manner and expanded twice in an expander to a bulk density of 0.3 pounds per cubic foot and allowed to contract while cooling to a temperature of 83° F. The elements were then almost immediately put into two separate tubular containers of mesh/plastic film and allowed to cure to a temperature of 68° F. while re-expanding to a bulk density of less than 0.3 pounds per cubic foot.

Each container was a tube made of plastic flexible screen with square holes of 0.5 inches and strands of 0.020 inches and was tied at one end prior to packing with the elements. Each packed tube was fully packed with the thermoplastic elements and, after tying off the open end, measured 10 foot long with a diameter of 10 inches.

One tube was laid flat on a floor during curing and took on a cylindrical cross-section. During re-expansion and curing of the elements with the tube, the tube became rigid with the elements becoming tightly packed.

The second tube was laid flat on a floor with a board weighing 10 pounds on the top and along the entire length causing the packed tube to deform into an oblong cross-sectional shape. When the elements were fully cured, the tube maintained the oblong cross-sectional shape due t the tight packing.

The two packed tubes were then laid in a horizontal plane transversely of and on a conventional 2×4 board on a floor in a symmetric manner to determine the deflection of each end of the tubes. The cantilevered length of each end of each tube was thus about 5 feet less one half the thickness of the 2×4 board. The amount of deflection of each end of each tube was less than one inch. Thus, for these tubes, the degree of rigidity can be characterized in that when supported in a horizontal plane at a mid-point with at least one end extending therefrom in a cantilever manner, the end of the packed tube has a deflection relative to the horizontal plane of two inches or less.

The non-cured thermoplastic elements may also be used to make the drainage elements described in co-pending U.S. patent application Ser. No. 11/106,108, filed Apr. 14, 2005, the disclosure of which is incorporated herein. For example, a drainage element may be made of a tubular netting having a pair of closed ends and a mass of expanded loose fill discrete elements within the netting wherein the elements are characterized in having been expanded from an initial state to an expanded state after filling of the netting therewith and in imparting a degree of rigidity to the drainage element in the expanded shape sufficient to maintain an expanded three dimensional shape of the netting. The drainage element may also be made with or without a pipe that may itself be corrugated or not and perforated or not. In any case, the pipe would extend beyond the closed ends of the netting to be able to connect with other pipes or components of a drainage system.

The rigidity of the drainage tubes made in accordance with the invention allows the tubes to be easily handled and put into place in the field as compared to drainage tubes that are readily flexible and that may snag on equipment in the field.

The invention thus provides a technique for using expandable thermoplastic elements for making articles of three-dimensional shape that have a rigid construction. The method of the invention may be used to make drainage tubes, flotation devices, lateral tubes for a septic system, bumpers for divided highways and toll booths, packing, decorative roofing, recreational floats, toys and the like.

The invention also provides a technique for packaging articles within containers in a tight-fit manner.

What is claimed is:

1. An article of manufacture comprising a container of flexible material characterized in having been expanded from a collapsed state into an expanded three dimensional shape; and a mass of expanded loose fill discrete thermoplastic elements within said container characterized in having been placed in said container in a non-cured expanded initial state and thereafter expanded from said initial state to a further expanded cured state without external manipulation while in said container and in imparting a degree of rigidity to said container in said expanded shape thereof sufficient to maintain said expanded three dimensional shape of said container.

2. An article of manufacture as set forth in claim 1 wherein said container is made of plastic film having a plurality of holes of a size to permit the passage of air while retaining said loose fill elements.

3. An article of manufacture as set forth in claim 1 wherein said three dimensional shape includes a first section forming a seat cushion and a second section forming a back cushion.

4. An article of manufacture as set forth in claim 1 wherein said container is a pouch having an open end and means for selectively closing said open end to seal said discrete elements within said pouch.

5. An article of manufacture as set forth in claim 4 wherein said discrete elements are made of expanded polystyrene.

6. An article of manufacture as set forth in claim 1 wherein said container is a tube having a pair of closed ends and plurality of holes of a size to permit the passage of air while retaining said loose fill elements.

7. An article of manufacture as set forth in claim 6 wherein said loose fill elements have a bulk density of less than 1.0 pounds per cubic foot.

8. The combination comprising a container having at least one wall defining a confined space; and a mass of discrete cured thermoplastic elements within said space and abutting said wall, said elements being characterized in having been expanded from within under ambient temperature without external manipulation from an initial non-cured expanded state to a cured further expanded state after filling of said space therewith and in imparting a degree of rigidity to said wall in said expanded state.

9. The combination as set forth in claim 8 wherein said wall forms an outside surface of a flotation device.

10. The combination as set forth in claim 8 wherein said container is a packing carton of cubic shape.

* * * * *